United States Patent [19]

Banks

[11] 3,947,933

[45] Apr. 6, 1976

[54] METHOD OF CONSTRUCTING DISHED ION THRUSTER GRIDS TO PROVIDE HOLE ARRAY SPACING COMPENSATION

[75] Inventor: Bruce A. Banks, Olmsted Township, Ohio

[73] Assignee: The United States of America as represented by the Administrator of the National Aeronautics and Space Administration, Washington, D.C.

[22] Filed: Jan. 20, 1975

[21] Appl. No.: 542,157

[52] U.S. Cl. ..... 29/25.18

[51] Int. Cl.[2] ..... H01J 9/00

[58] Field of Search ..... 72/296, 297, 302, 308, 72/309, 378; 113/116 A; 29/6.1, 25.18, 163.5 R

[56] References Cited

UNITED STATES PATENTS

| | | | |
|---|---|---|---|
| 3,296,850 | 1/1967 | Fiore | 29/163.5 R |
| 3,809,945 | 5/1974 | Roeder | 29/25.18 |
| 3,864,797 | 2/1975 | Banks | 29/25.18 |

*Primary Examiner*—Milton S. Mehr

*Attorney, Agent, or Firm*—Norman T. Musial; G. E. Shook; John R. Manning

[57] ABSTRACT

The center-to-center spacings of a photoresist pattern for an array of holes applied to a thin metal sheet are increased by uniformly stretching the thin metal sheet in all directions along the plane of the sheet. The uniform stretching is provided by securely clamping the periphery of the sheet and applying an annular force against the face of the sheet, within the periphery of the sheet and around the photoresist pattern. The technique used in the construction of ion thruster grid units wherein the outer or downstream grid is subjected to uniform stretching prior to convex molding. The technique provides alignment of the holes of grid pairs so as to direct the ion beamlets in a direction parallel to the axis of the grid unit and thereby provide optimization of the available thrust.

3 Claims, 4 Drawing Figures

METHOD OF CONSTRUCTING DISHED ION THRUSTER GRIDS TO PROVIDE HOLE ARRAY SPACING COMPENSATION

ORIGIN OF THE INVENTION

The invention described herein was made by an employee of the United States Government and may be manufactured or used by or for the Government without the payment of any royalties thereon or therefor.

FIELD OF THE INVENTION

The present invention relates to ion thrusters and more particularly to a method for providing improved hole array spacing for dished ion thruster grids.

BACKGROUND OF THE INVENTION

Ion thrusters conventionally include grid units comprising thin metal sheet grids, provided with arrays of holes and molded into convex, or dish, shapes. Such a grid unit characteristically comprises a pair of dish shaped grids mounted one beside the other and spaced a small distance apart. In prior arts methods of making these grid units, the grids of the units, being produced in precisely the same manner and hence having the same orientation, suffer the disadvantage that, when disposed as set forth above, the holes in the two grids are misaligned such that the thrust vectors produced are oriented away from the thruster centerline by an amount which increases with the distance from the center of the grids.

More specifically, presently used methods of making these convex grid units generally entail disposing exposed and developed photoresist patterns for the desired array of holes onto two thin metal sheets. The two thin metal sheets are then laid one on top of the other such that the photoresist patterns for the arrays of holes on the sheets are in alignment. The sheets are secured together, as by tape, and a convex shape is simultaneously imparted to the sheets, such as by hydroforming techniques. The two convex shaped sheets are next subjected to a chemical etching step to form the holes per the photoresist patterns, the sheets then being simultaneously stress relieved, and mounted in the ion thruster apparatus, the inner grid being spaced a small distance from the outer grid. With this method of forming the grid units, the holes of the outer grid are displaced in relation to the corresponding holes of the inner grid by a small distance, x, measured in the plane of the tangents to the holes in a direction toward the centerline of the grid.

In operation, because of this displacement in the alignment of the holes of the two grids, the ions being thrust through the grids are deflected along paths which curve away from the centerline of the grid. Thus, a significant portion of the available thrust imparted to the ions is lost due to this directional misguidance of the ions.

SUMMARY OF THE INVENTION

According to the invention, a method of forming grids for use as ion thruster grid units includes a step wherein one of the grids, viz., the outer grid in the example being considered, is uniformly stretched in the flat plane of the grid prior to the step of imparting the desired shape to the grid. In general, this method results in a "negative" displacement of the holes of the outer or downstream grid relative to the inner grid such that the ions are thrust through the two grids along a path which is parallel to the longitudinal axis of the ion thruster.

The stretching step is advantageously effected by securely holding the periphery of the flat metal sheet with the photoresist pattern thereon, while forcing a circular die, having a raised lip around the periphery of its contact face, against the metal sheet perpendicular to the plane thereof. The uniform stretching of the sheet so produced enlarges the photoresist pattern thereon such that center-to-center spacing of the array of holes is enlarged. The technique provides grid units wherein the holes of the convex outer grid are at a negative displacement in relation to the corresponding holes of the convex inner grid so that, as noted above, ions thrust through the grid unit are deflected in a direction parallel the longitudinal axis of the ion thruster of the grid unit, thus optimizing the thrust efficiency of the ion thruster in which the grid unit is used.

Other features and advantages of the invention will be set forth, or apparent from, the detailed description of a preferred embodiment found hereinbelow.

DESCRIPTION OF THE PREFERRED EMBODIMENTS

Because ion thrusters are well known, the present description will be particularly directed to the elements forming part of, or cooperating more directly with, the present invention. Thus, it will be understood that portions of the ion thruster which are not specifically shown or described can take a number of different, conventional forms. For example, reference is made to my co-pending application Ser. No. 352,381, filed on Apr. 18, 1973, and entitled "Method of Making Dished Ion Thruster Grids," and now U.S. Pat. No. 3,864,797 for a further discussion of the construction of thruster grid units.

Figure 1:
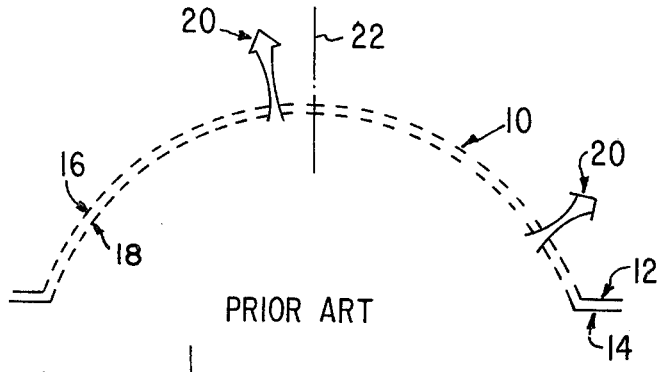
FIG. 1 is a highly schematic cross-sectional view of an ion thruster grid unit formed in accordance with prior art techniques, illustrating the deflection of the ion vectors.
Figure 2:
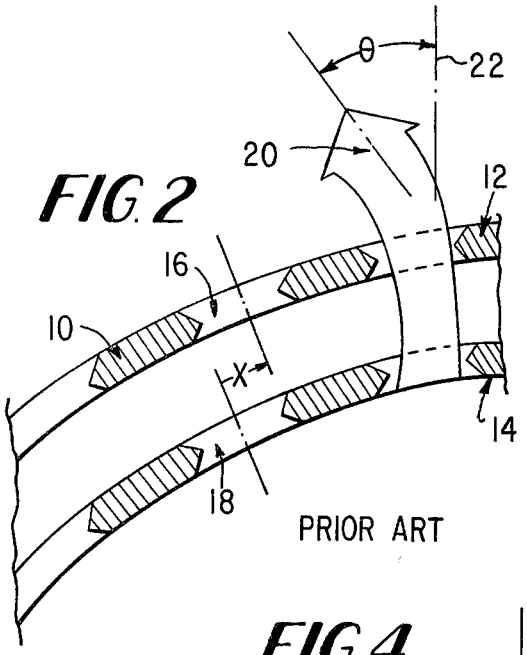
FIG. 2 is a detail, drawn to an enlarged scale, of the grid unit of FIG. 1, illustrating the relationship of the holes in two grids forming the grid unit.

Referring to FIG. 1, a typical prior art ion thruster grid unit, denoted 10, is shown which consists of an outer convex grid 12, and an inner convex grid 14 spaced a small distance from outer grid 12. Grid 12 and grid 14 are each provided with arrays of holes, denoted 16 and 18, respectively, through which ions are thrust in beamlets, generally denoted 20. As perhaps can be seen in the enlarged cross-sectional detail shown in FIG. 2, which depicts a grid unit in accordance with prior art methods of manufacture, the centerlines of holes 16 and 18 do not fall along the same line but instead, the centerline of hole 16 is displaced in relation to the centerline of corresponding hole 18 a distance $x$, toward the grid center, in the plane of the tangent of hole 16. The reason for this displacement is that the grids 12, 14 are separated a small distance from each other when mounted for operation by moving one grid away from the other along the centerline of the grids, which is denoted by 22 in FIG. 1. As a result of the two nearly identical grid shapes and the small separation therebetween, when the grids 12, 14 are mounted for operation, the value of $x$ is a maximum at the outer edge of the grid unit 10 and zero at the central grid axis 22. In a typical 30 cm diameter grid unit, the maximum value of $x$ is about 0.010 to 0.015 inches. Thus, as illustrated in FIG. 2, ion beamlet 20 is deflected by an angle $\theta$ from a line 22*a* which is parallel to the grid axis centerline 22. This ion beamlet deflection obviously results in a thrust loss and, overall, in a less than optimum thrust pattern.

Figure 3:
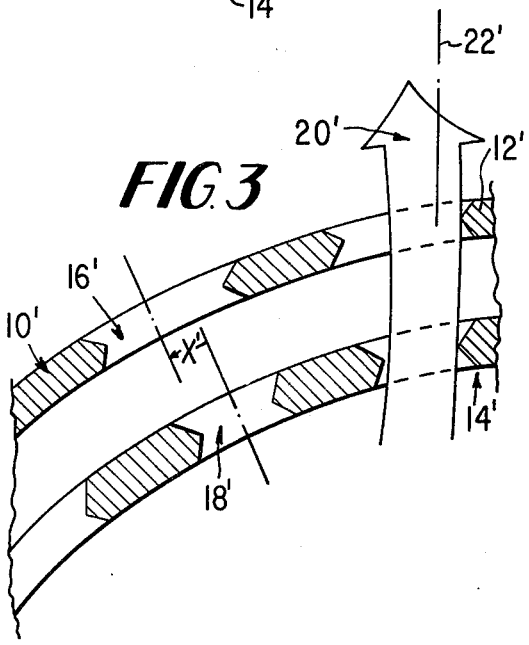
FIG. 3 is a detail, similar to that of FIG. 2, of a grid unit constructed in accordance with the invention, illustrating the relationship of the holes in the two grids forming the grid unit.

Referring to FIG. 3, a detail similar to that of FIG. 2 is shown, in which elements similar to those of FIG. 2 are given the same numbers with primes attached. In FIG. 3, a grid unit 10′ is shown which is constructed according to the method of the invention by uniformly stretching grid 12′ in its own, flat plane, prior to the step of dishing the grid to impart the convex shape. In this way the array of holes 16′ of grid 12′ is stretched such that the center-to-center spacing between holes 16′ is increased. Thus, after the dishing and stretching steps, a grid unit 10′ is provided wherein the centerline of a hole 16′ is displaced a "negative" distance $x'$ away from the grid axis, in the plane of the tangent to hole 16′, in relation to a corresponding hole 18′. The result is that illustrated, viz., a deflection of ion beamlet 20′ so as to follow a path which is parallel to grid axis 22′. Thus, the thrust losses due to the misdirection or deflection of the ions produced by the grid unit of FIGS. 1 and 2 are eliminated.

Figure 4:
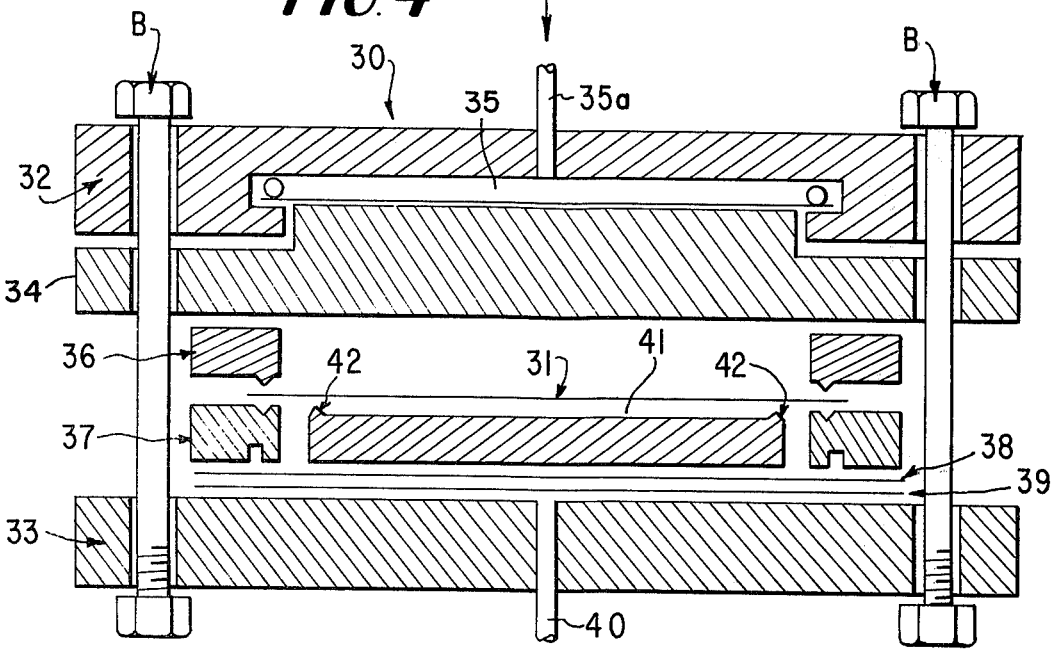
FIG. 4 is a schematic cross-sectional view of an apparatus used in uniformly stretching a grid sheet, according to a specific embodiment of the invention.

Referring to FIG. 4, there is shown an apparatus which is generally denoted 30 and which is used, in accordance with a preferred embodiment, in uniformly stretching the outer grid in all directions in the plane of the grid, prior to molding the grid into a convex shape. In use, a thin metal grid sheet 31 which has an exposed and developed photoresist pattern for the array of holes is placed within upper and lower generally circular housings 32 and 33 of apparatus 30. The housing sections 32 and 33 are joined together by a series of bolts B which also serve to guide the movement of an intermediate pressure plate 34. Water pressure is applied to a chamber 35 within upper housing 30 through inlet 35*a*, chamber 35 being located above presssure plate 34 and the water pressure forcing pressure plate 34 downwardly to an engage annular clamping ring 36 disposed above grid sheet 31. Ring 36 is thus forced to engage a second annular clamping ring 37 disposed beneath grid sheet 31, thereby securely clamping the periphery of sheet 31 in place. A further build up of pressure in chamber 35 causes clamping of a metal plate 38 and a rubber gasket 39 between ring 37 and lower housing 33. A circular plate 41, is positioned within clamping ring 37 beneath grid sheet 31 and above metal plate 38, includes an annular lip 42 around the upper peripheral edge thereof. Hydraulic pressure applied to an inlet 40 forces plate 41 upwardly so that the raised lip 42 presses against sheet 31, thereby causing uniform stretching of sheet 31 in all directions of the plane of the sheet. This stretching of sheet 31 also stretches the photoresist pattern on sheet 31 and thus increases the photoresist hole array center-to-center hole spacings. When the desired amount of permanent stretching is obtained, the pressures are released and the sheet 31 which is now of a pie plate shape is removed. The unetched, stretched grid sheet so formed is then trimmed so as to remove the bent portions around its periphery.

In a forming and etching step, the trimmed grid is taped to another photoresist patterned, unetched, unstretched grid sheet which will become the inner convex grid of the grid unit. The pair of sheets are taped so that the photoresist patterns for the hole arrays are oriented with the pattern centers consistently in alignment. The two grids of the grid unit so formed are simultaneously hydroformed to impart thin convex shape and then chemically etched so as to form holes therein according to the photoresist patterns. The grids are then simultaneously stress relieved.

In a final step, the grids are mounted on rings (not shown) and installed in ion thruster apparatus such that the inner grid is spaced a small distance from the outer grid and the arrays of holes are in alignment as discussed above.

It will be understood that the method of the invention can be practiced with the desired results on grids of any shape, hole pattern or hole shape. It can also be practiced on grid sheets which have thin holes etched therein before the stretching and molding steps. It will be appreciated that if the desired operating orientation of the grid unit is reversed, that is, the grid presents a concave surface in a downstream direction, then the method of the invention entails merely reversing the installation of the grids, so that the unstretched grid will be installed on the downstream side of the grid unit.

Although the invention has been described with respect to an exemplary embodiment thereof, it will be understood that other variations and modifications can be affected in the embodiment without departing from the scope or spirit of the invention.

I claim:

1. In a method of forming an ion thruster grid unit comprising the steps of applying first and second thin metal sheets to photoresist patterns corresponding to an array of holes; molding said thin metal sheets to impart a predetermined shape thereto; chemically etching the thin metal sheets to form holes therethrough according to said photoresist patterns; and mounting said molded sheets in parallel side by side relationship such that the two sheets are separated a small axial distance from each other; the improvement which comprises uniformly stretching one of said grids in the plane of said grid prior to said molding step such that said photoresist pattern corresponding to an array of holes is enlarged to increase the center-to-center spacing of the holes of said array of holes.

2. The method of claim 1 wherein said two sheets are combined and simultaneously dished in said dishing step to impart a convex shape thereto.

3. The method of claim 1 wherein said stretching step comprises securing the periphery of said thin metal sheet constituting said one grid against movement and pressing a circular die having a raised lip on the face thereof around the periphery against said thin metal sheet to uniformly stretch said thin metal sheet.

* * * * *